US008536432B1

(12) United States Patent
Herring

(10) Patent No.: US 8,536,432 B1
(45) **Date of Patent: *Sep. 17, 2013**

(54) GUITAR REST

(76) Inventor: Shannon Herring, St. Francisville, LA (US)

( * ) Notice: Subject to any disclaimer, the term of this patent is extended or adjusted under 35 U.S.C. 154(b) by 778 days.

This patent is subject to a terminal disclaimer.

(21) Appl. No.: 10/832,989

(22) Filed: Apr. 27, 2004

Related U.S. Application Data

(63) Continuation-in-part of application No. 09/570,759, filed on May 15, 2000, now Pat. No. 6,727,415.

(60) Provisional application No. 60/133,903, filed on May 13, 1999.

(51) Int. Cl.
*G10D 3/00* (2006.01)

(52) U.S. Cl.
USPC ..... 84/327

(58) Field of Classification Search
USPC ..... 84/267, 290–293, 327, 329
See application file for complete search history.

(56) References Cited

U.S. PATENT DOCUMENTS

| | | | | | |
|---|---|---|---|---|---|
| 4,099,441 | A | | 7/1978 | Landon | |
| 4,223,785 | A | | 9/1980 | Jacques | |
| 4,474,290 | A | * | 10/1984 | DeMato | 206/314 |
| 4,515,272 | A | | 5/1985 | Newhouse | |
| 5,024,328 | A | | 6/1991 | Bontrager | |
| 5,029,796 | A | | 7/1991 | Schoenig | |
| 5,149,901 | A | | 9/1992 | Boor et al. | |
| 5,207,327 | A | | 5/1993 | Brondos | |
| 5,219,075 | A | | 6/1993 | White | |
| 5,363,734 | A | * | 11/1994 | Wilenken | 84/327 |
| 5,375,497 | A | * | 12/1994 | Pirchio et al. | 84/327 |
| 5,442,986 | A | * | 8/1995 | Cota | 84/267 |
| 5,497,689 | A | | 3/1996 | Hoshine | |
| 5,590,771 | A | | 1/1997 | Cota | |
| 5,616,874 | A | | 4/1997 | Kraus et al. | |
| 5,713,465 | A | | 2/1998 | Choe | |
| 5,816,395 | A | | 10/1998 | Dougherty | |
| 5,833,051 | A | * | 11/1998 | Tiefenbrun et al. | 206/14 |
| 5,876,813 | A | | 3/1999 | Bambara et al. | |
| 5,911,396 | A | | 6/1999 | Bireley | |
| 5,986,193 | A | | 11/1999 | Garrison | |
| 6,130,375 | A | | 10/2000 | Kellogg et al. | |
| 6,727,415 | B1 | | 4/2004 | Herring | |

FOREIGN PATENT DOCUMENTS

| | | |
|---|---|---|
| GB | 2276314 | 8/1994 |

* cited by examiner

*Primary Examiner* — Kimberly Lockett
(74) *Attorney, Agent, or Firm* — Garvey, Smith, Nehrbass & North, L.L.C.; Seth M. Nehrbass; Mackenzie D. Rodriguez

(57) ABSTRACT

A rest for guitar-like instruments is internally configured to receive the bottom of a guitar-like instrument and to allow the instrument to lean against another object. Preferably, a groove is provided in the bottom of the rest to allow the rest to fit over the handle of an amplifier. Also, the cavity is preferably shaped such that the back of the top of the guitar-like instrument leans on a wall or other supporting structure.

14 Claims, 22 Drawing Sheets

GUITAR REST

CROSS-REFERENCE TO RELATED APPLICATIONS

This is a continuation-in-part of my prior U.S. patent application Ser. No. 09/570,759, filed 15 May 2000, now U.S. Pat. No. 6,727,415, and incorporated herein by reference. Priority of my U.S. Provisional Patent Application Ser. No. 60/133,903, filed 13 May 1999, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to accessories for musical instruments More particularly, the present invention relates to guitar accessories.

2. General Background of the Invention

Contemporary instrument stands are designed to totally support the weight and balance of an instrument (freestanding or hanging). Generally made from heavy steel tubing or hardened plastics, they generally require some assembly plus take up a lot of floor space and have a tendency to become tripping hazards or snag points, leaving a sense of insecurity for the instrument.

The following U.S. patents are incorporated herein by reference:

U.S. Pat. No. 4,099,441; U.S. Pat. No. 4,223,785; U.S. Pat. No. 4,474,290; U.S. Pat. No. 4,515,272; U.S. Pat. No. 5,024,328; U.S. Pat. No. 5,029,796; U.S. Pat. No. 5,149,901; U.S. Pat. No. 5,207,327; U.S. Pat. No. 5,219,075; U.S. Pat. No. 5,375,497; U.S. Pat. No. 5,497,689; U.S. Pat. No. 5,590,771; U.S. Pat. No. 5,616,874; U.S. Pat. No. 5,713,465; U.S. Pat. No. 5,816,395; U.S. Pat. No. 5,833,051; U.S. Pat. No. 5,876,813; U.S. Pat. No. 5,911,396; U.S. Pat. No. 5,986,193; and U.S. Pat. No. 6,130,375.

Also incorporated by reference is UK Patent Application No. GB 2 276 314 and the references cited therein and in the U.S. patents mentioned above.

BRIEF SUMMARY OF THE INVENTION

The present invention is a rest for guitar-like instruments which is internally configured to receive the bottom of a guitar-like instrument and to allow the instrument to lean against another object. Preferably, a groove is provided in the bottom of the rest to allow the rest to fit over the handle of an amp (though the amp handle groove dimensions will vary based on the style of amp handle and type of instrument for which the rest is designed—some models of the rest of the present invention will be designed without an amp handle groove). Also, the cavity is preferably shaped such that the back of the top of the guitar-like instrument leans on the wall or other supporting structure.

The instrument rest of the present invention can be designed to fit any commercially available guitar or other stringed instrument, or other musical instruments.

The outside of the instrument rest of the present invention can be square, rounded, or sculpted to basically any size or shape.

Some light guitar-like instruments will stand up in the instrument rest of the present invention with no other support.

The present invention also comprises a neck support cushion, which is preferably used with the instrument rest of the present invention.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

The Instrument Rest Method

Figure 1:
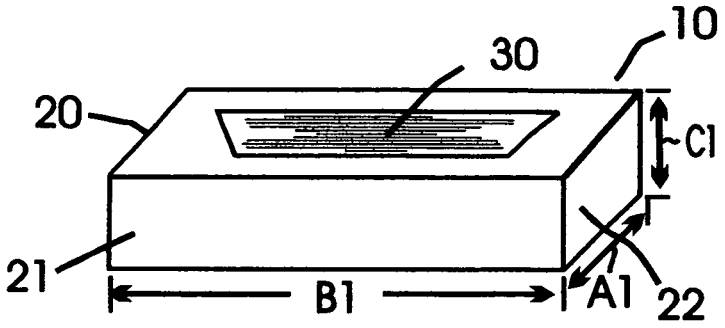
FIG. 1 is a perspective view of the preferred embodiment of the apparatus of the present invention.
Figure 2:
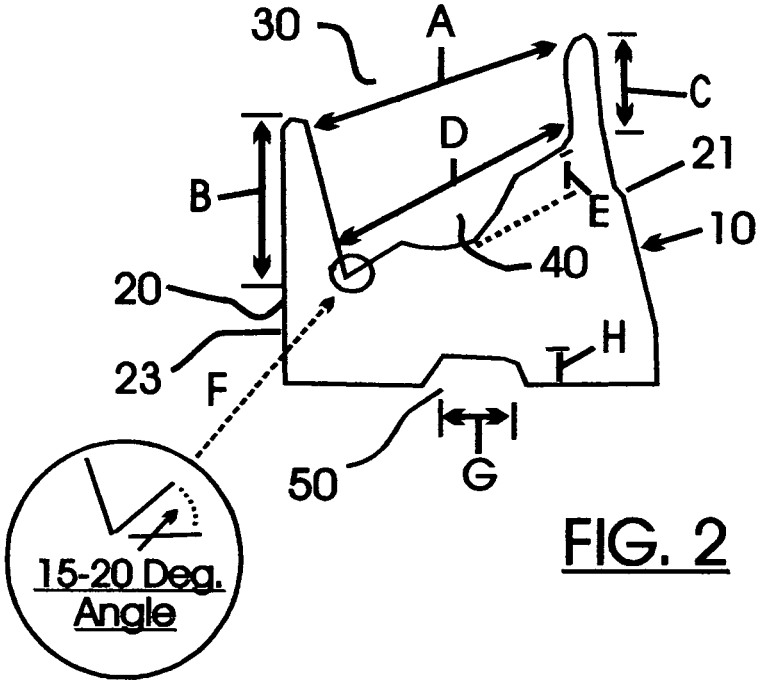
FIG. 2 is a cross-sectional view of the preferred embodiment of the apparatus of the present invention, taken along the lines II-II in FIG. 6.
Figure 3:
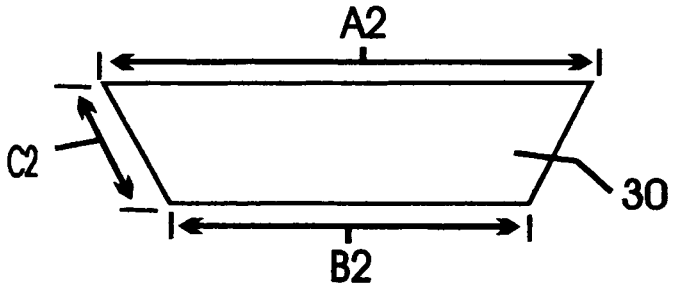
FIG. 3 is a top view of the preferred embodiment of the apparatus of the present invention.
Figure 4:
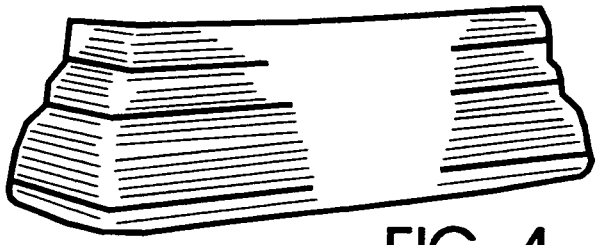
FIG. 4 is a perspective view of the preferred embodiment of the apparatus of the present invention.
Figure 5:
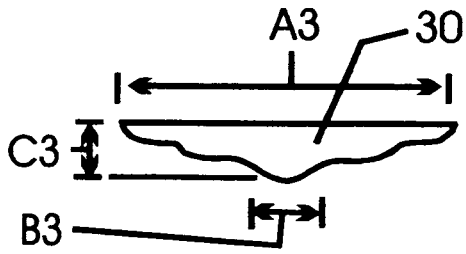
FIG. 5 is a cross-sectional view of the cavity of the preferred embodiment of the apparatus of the present invention, taken along the lines V-V in FIG. 6.
Figure 6:
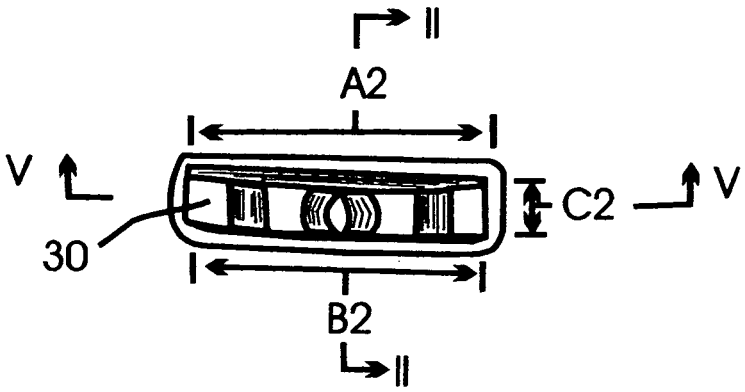
FIG. 6 is a top view of the preferred embodiment of the apparatus of the present invention.
Figure 7:
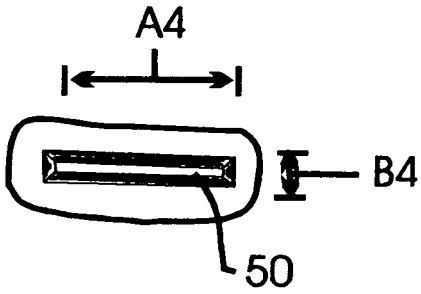
FIG. 7 is a bottom view of the preferred embodiment of the apparatus of the present invention.
Figure 8:
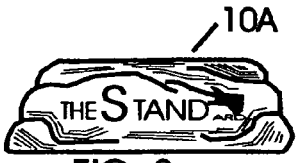
FIGS. 8-28 are views of various ornamental designs for the outside of the present invention.
Figure 9:
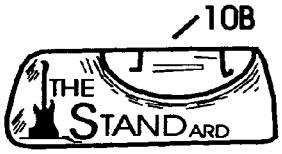
Figure 10:
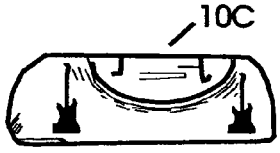
Figure 11:
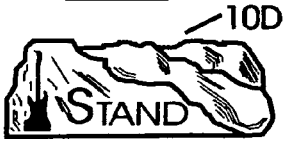
Figure 12:
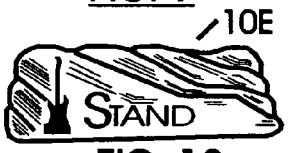
Figure 13:
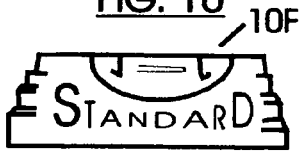
Figure 14:
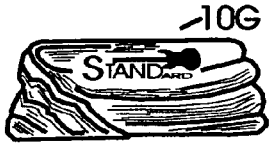
Figure 15:
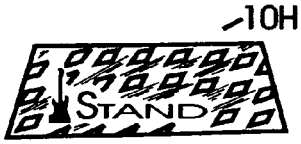
Figure 16:
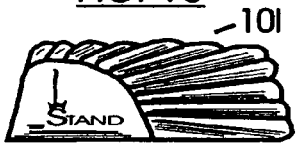
Figure 17:
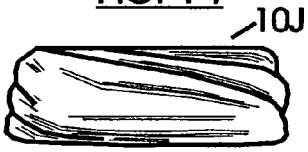
Figure 18:
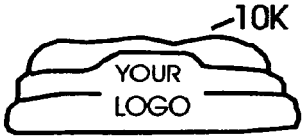
Figure 19:
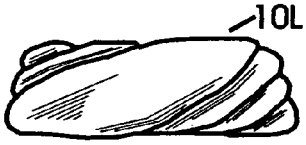
Figure 20:
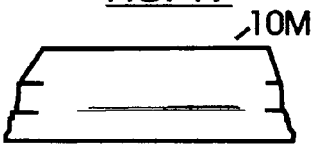
Figure 21:
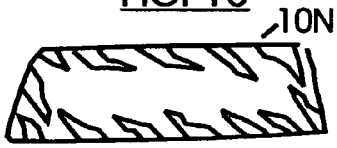
Figure 22:
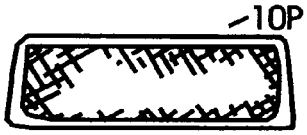
Figure 23:
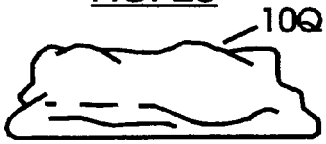
Figure 24:
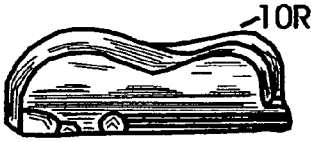
Figure 25:
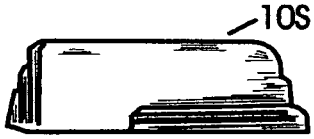
Figure 26:
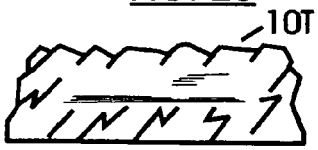
Figure 27:
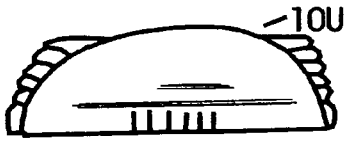
Figure 28:
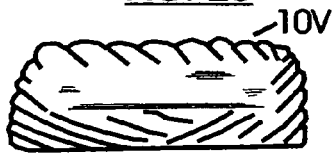
Figure 29:
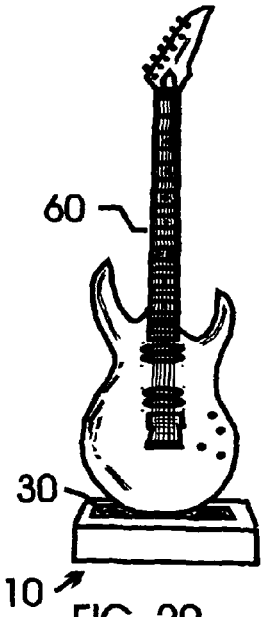
FIG. 29 is a perspective view of the preferred embodiment of the apparatus of the present invention with an electric guitar being inserted therein.
Figure 30:
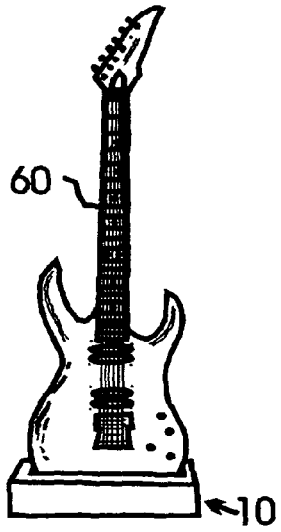
FIG. 30 is a perspective view of the preferred embodiment of the apparatus of the present invention with an electric guitar inserted therein.
Figure 31:
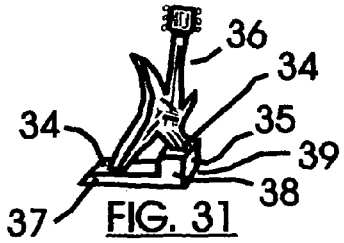
FIG. 31 is a perspective view of an alternative embodiment of the apparatus of the present invention with a stringed instrument inserted therein.
Figure 32:
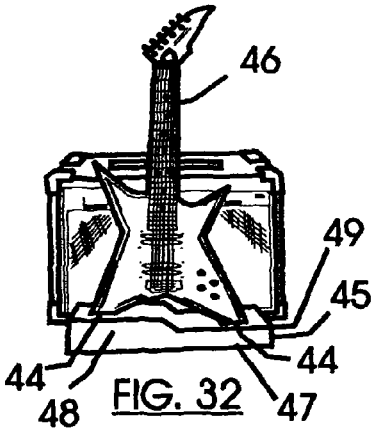
FIG. 32 is a perspective view of an alternative embodiment of the apparatus of the present invention with a guitar inserted therein and leaning against an amp.
Figure 33:
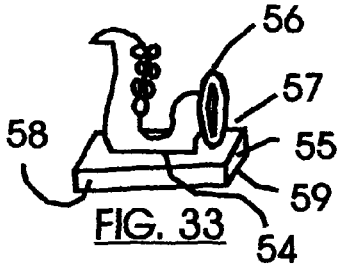
FIG. 33 is a perspective view of an alternative embodiment of the apparatus of the present invention with a horn inserted therein.
Figure 35:
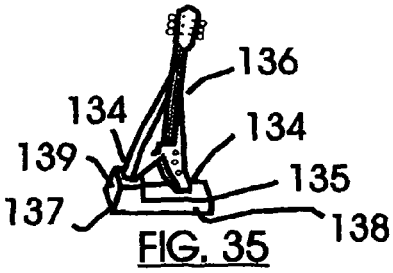
FIG. 35 is a perspective view of an alternative embodiment of the apparatus of the present invention with a stringed instrument inserted therein.
Figure 34:
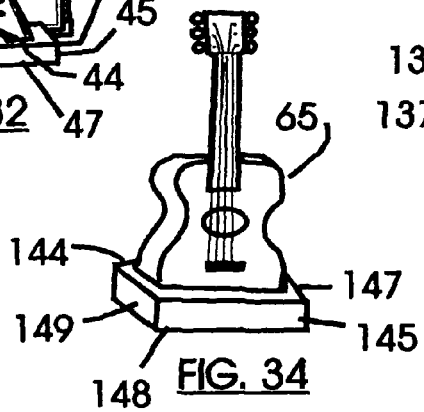
FIG. 34 is a perspective view of an alternative embodiment of the apparatus of the present invention with a box guitar inserted therein.
Figure 36:
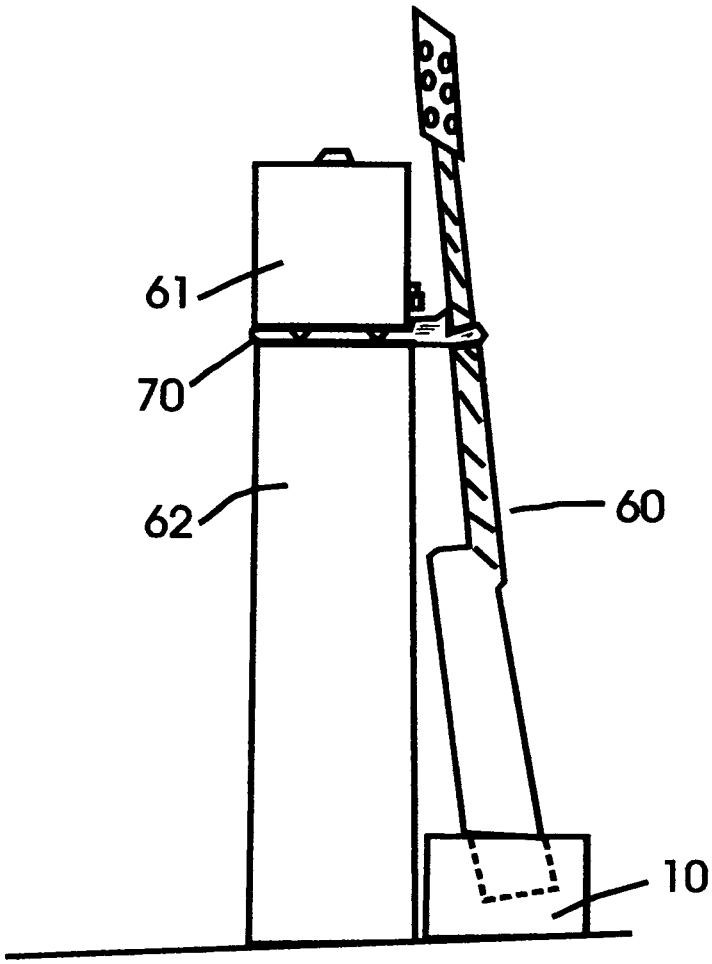
FIG. 36 is a side view showing the preferred embodiment of the apparatus of the present invention with an electric guitar inserted therein, and the guitar leaning against a neck rest pad of the preferred embodiment of the present invention.
Figure 37:
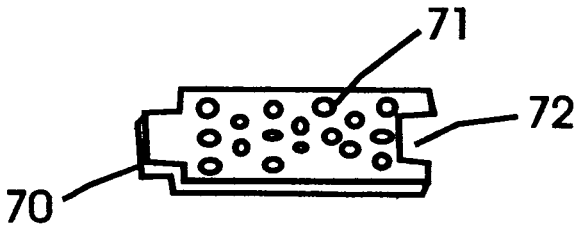
FIG. 37 is a top view of the neck rest pad of the preferred embodiment of the present invention.
Figure 38:
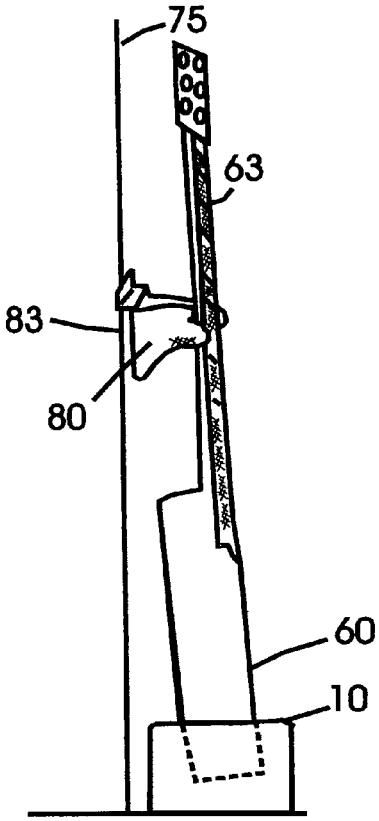
FIG. 38 is a side view showing the preferred embodiment of the apparatus of the present invention with an electric guitar inserted therein, and the guitar leaning against a keyboard neck rest pad of the preferred embodiment of the present invention.
Figure 40:
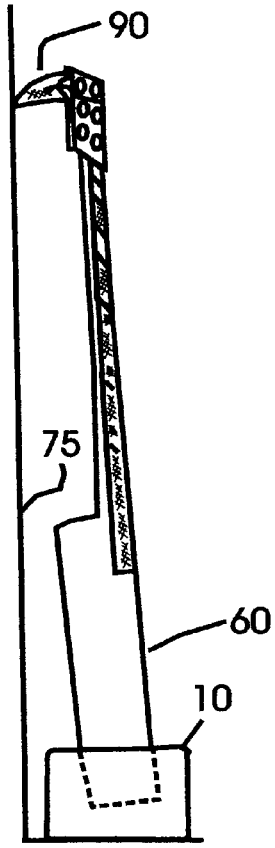
FIG. 40 is a side view showing the preferred embodiment of the apparatus of the present invention with an electric guitar inserted therein, and the guitar leaning against a headstock rest pad of the preferred embodiment of the present invention.
Figure 43:
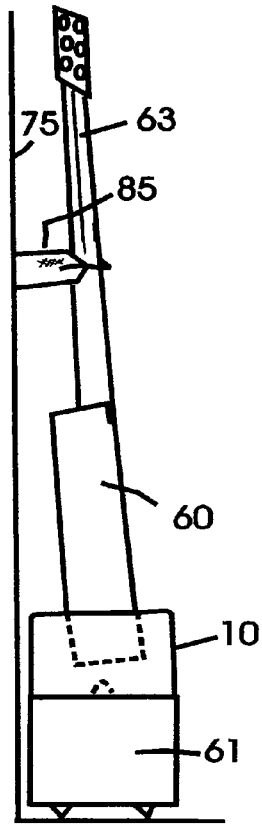
FIG. 43 is a side view showing the preferred embodiment of the apparatus of the present invention sitting on an amp and with an electric guitar inserted therein, and the guitar leaning against a keyboard neck rest pad of an alternative embodiment of the present invention.
Figure 39:
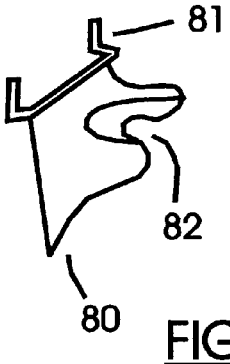
FIG. 39 is a perspective view of the keyboard neck rest pad of the preferred embodiment of the present invention.
Figure 41:
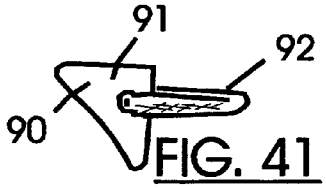
FIG. 41 is a side view of the headstock rest pad of the preferred embodiment of the present invention.
Figure 42:
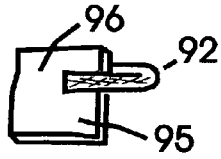
FIG. 42 is a side view of a headstock rest pad of an alternative embodiment of the present invention.
Figure 44:
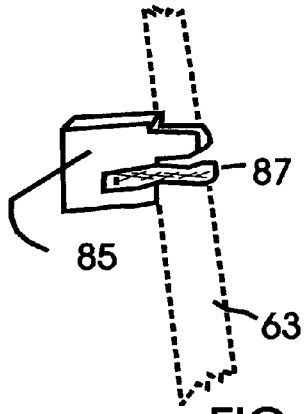
FIG. 44 is a perspective view of the keyboard neck rest pad of an alternative embodiment of the present invention.
Figure 45:
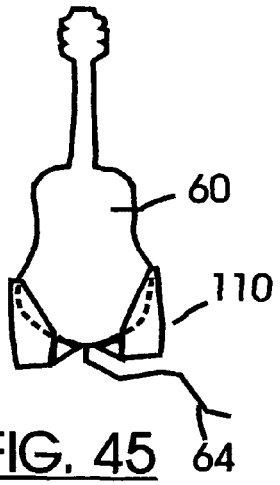
FIG. 45 is a front view of a guitar rest of an alternative embodiment of the present invention, with a guitar therein.
Figure 46:
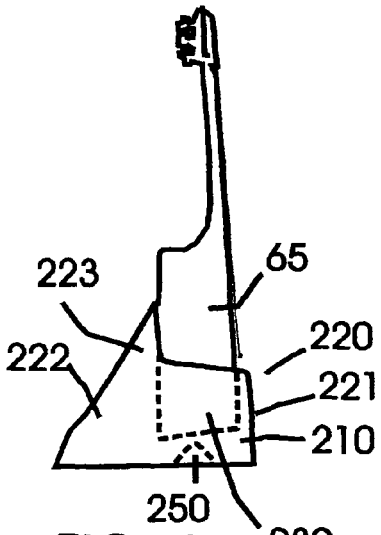
FIG. 46 is a side view of a guitar rest of an alternative embodiment of the present invention, with a guitar therein.
Figure 47:
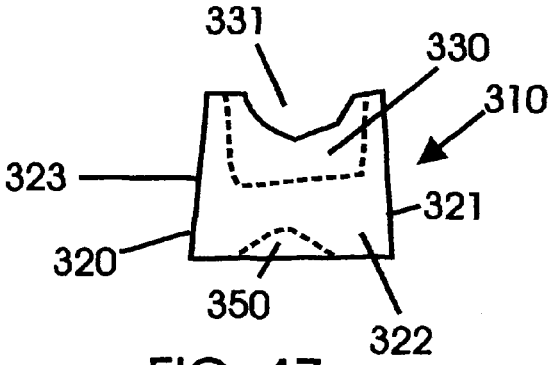
FIG. 47 is a side view of a guitar rest of an alternative embodiment of the present invention.
Figure 49:
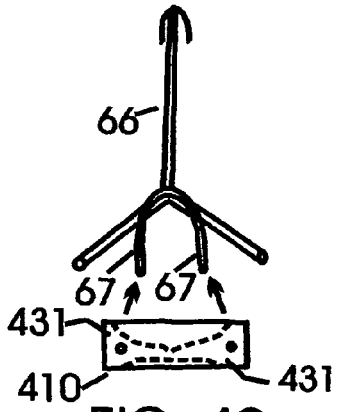
FIG. 49 is a front view of the guitar rest of a FIG. 48 and a tripod stand.
Figure 48:
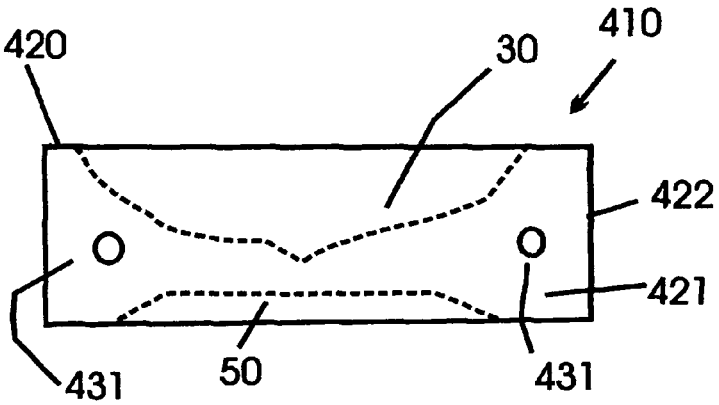
FIG. 48 is a front view of a guitar rest of an alternative embodiment of the present invention.
Figure 50:
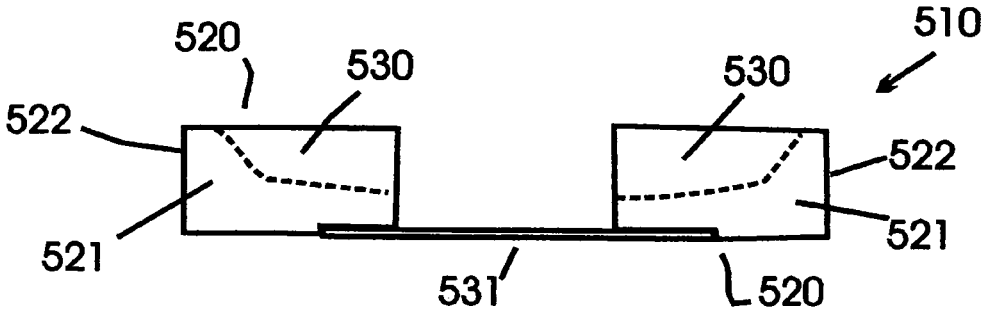
FIG. 50 is a front view of a guitar rest of an alternative embodiment of the present invention.
Figure 51:
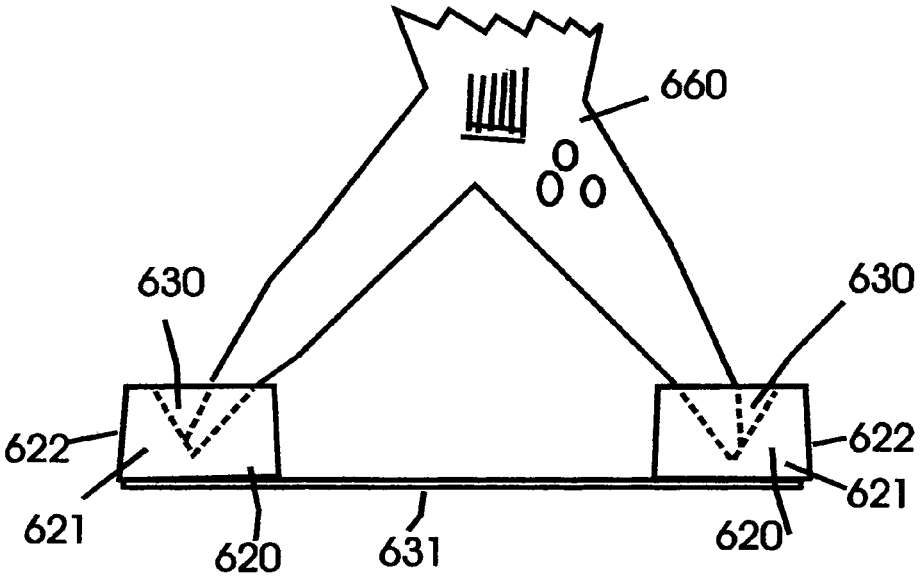
FIG. 51 is a front view of a guitar rest of an alternative embodiment of the present invention.
Figure 52:
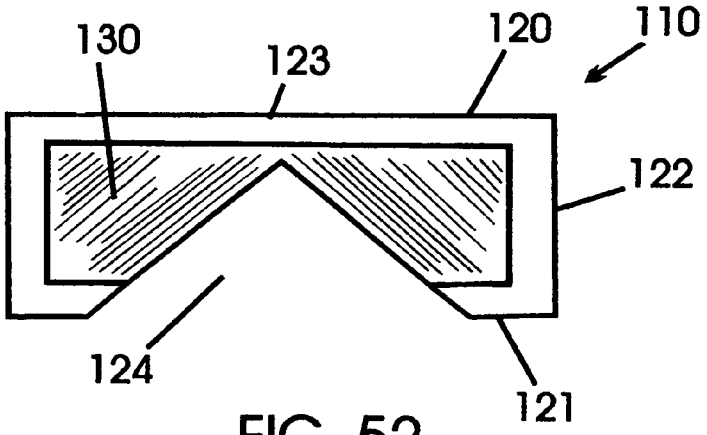
FIG. 52 is a top view of the guitar rest of the present invention shown in FIG. 45.
Figure 53:
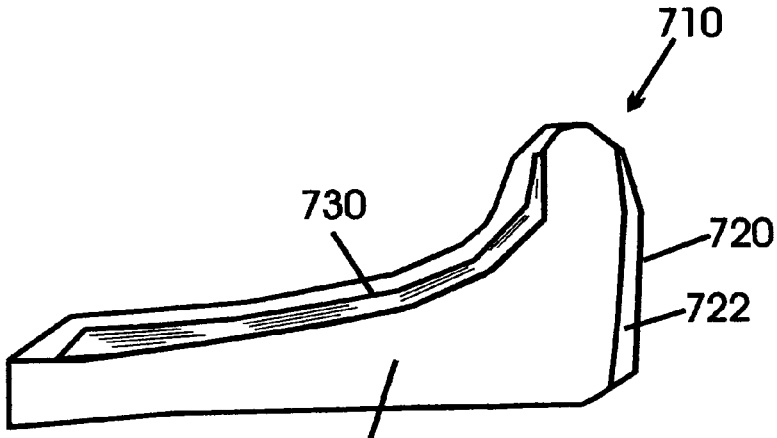
FIGS. 53-56 are front perspective views of guitar rests of alternative embodiments of the present invention.
Figure 54:
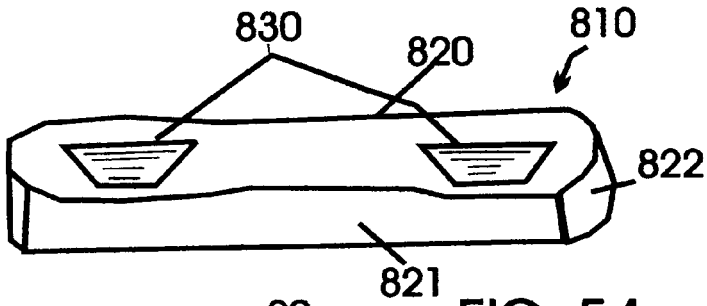
Figure 55:
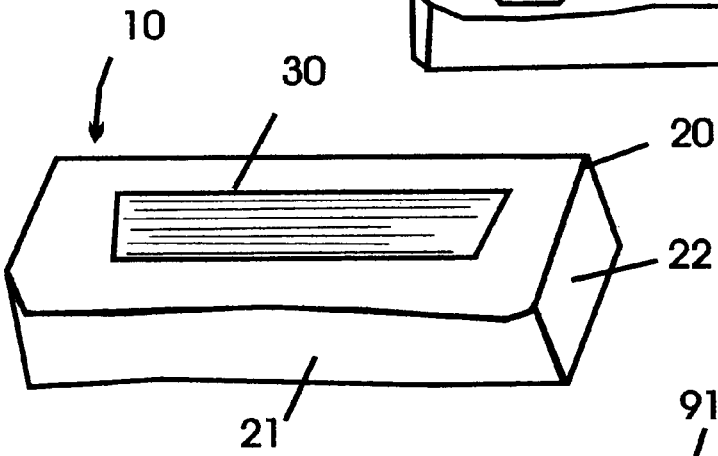
Figure 56:
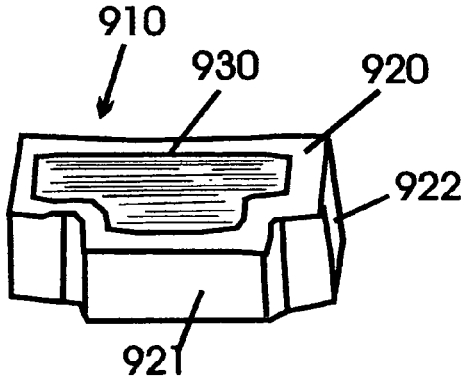
Figure 57:
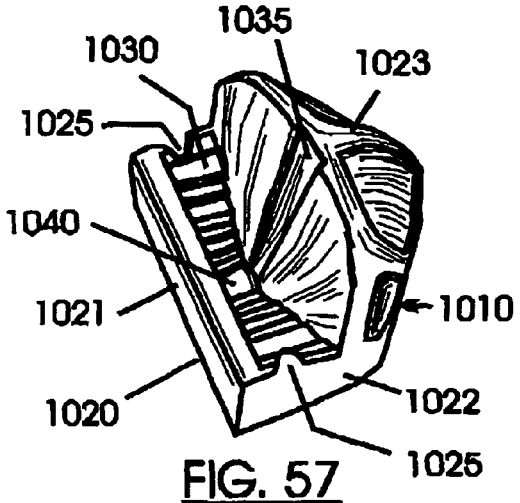
FIGS. 57-60 is a perspective view of a guitar rest of an alternative embodiment of the present invention as represented in FIG. 46.
Figure 58:
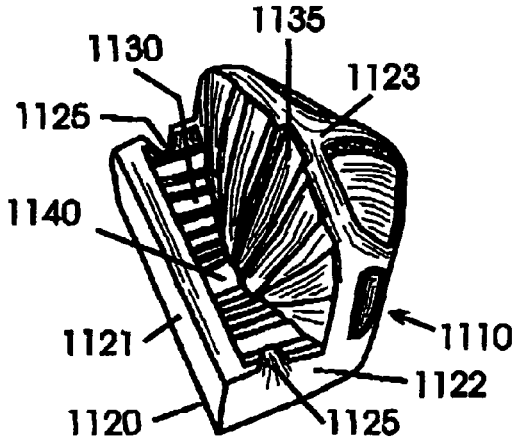
Figure 59:
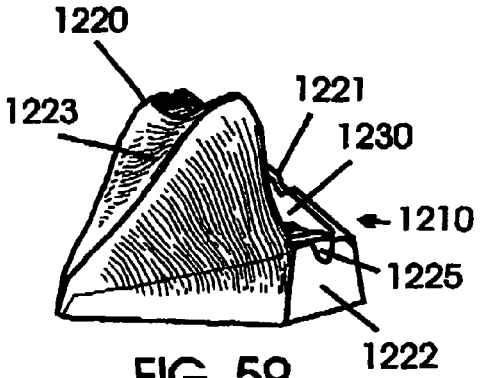
Figure 60:
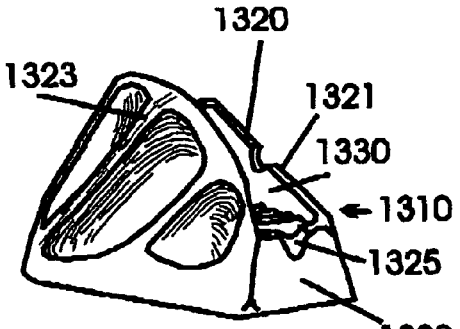
Figure 61:
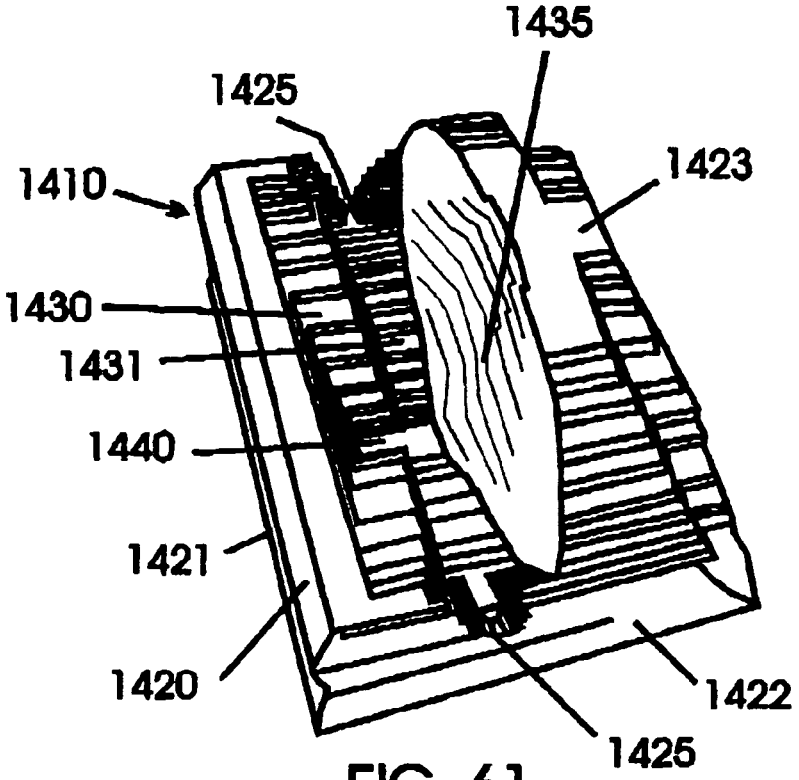
FIG. 61 is a perspective view of a guitar rest of an alternative embodiment of the present invention.
Figure 62:
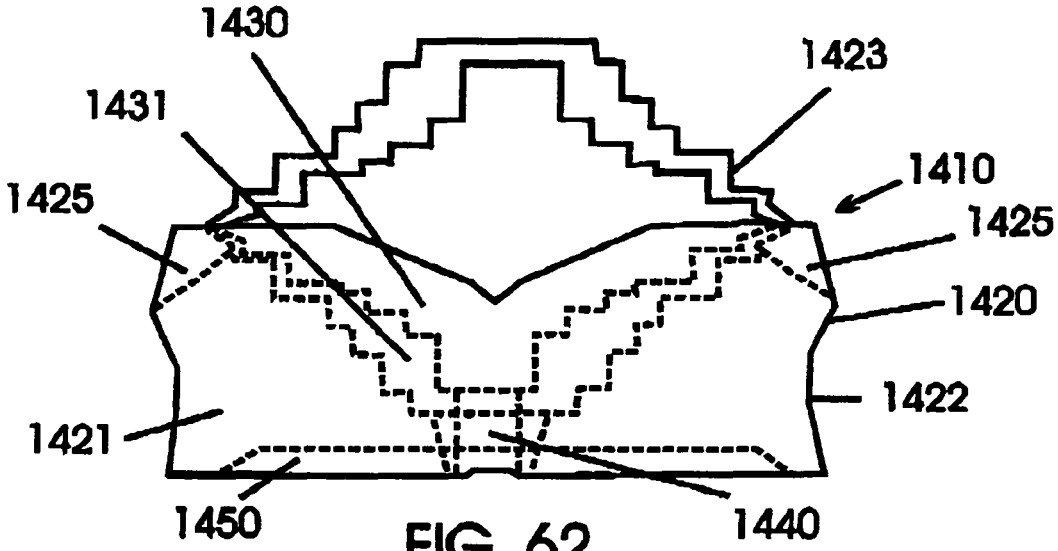
FIG. 62 is a front view of a guitar rest of an alternative embodiment of the present invention.
Figure 63:
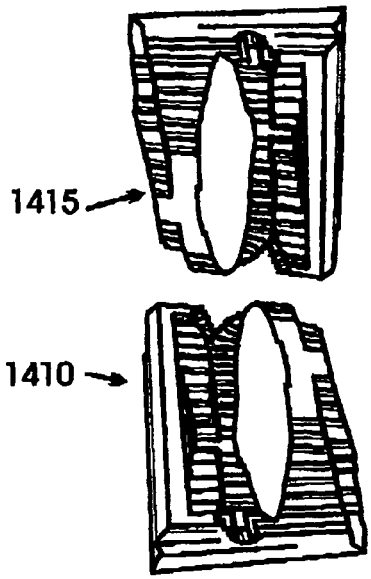
FIG. 63 is a perspective view of two guitar rest of an alternative embodiment of the present invention, one being flipped over to interlock with the other, for the purposes of shipping and storage.
Figure 64:
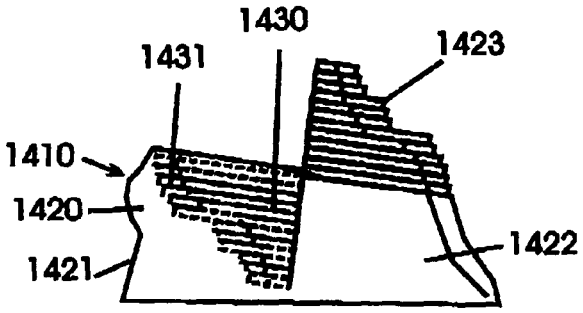
FIG. 64 is a side view of the preferred alternative embodiment f the apparatus of the present invention, one being flipped over to interlock with the other.
Figure 65:
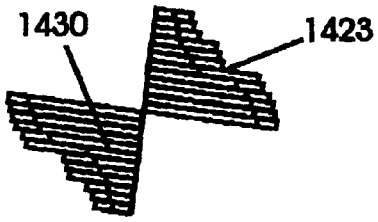
FIG. 65 is a side view of a cavity for receiving guitar like instrument and an interlocking rear support of the same guitar rest of the present invention.
Figure 66:
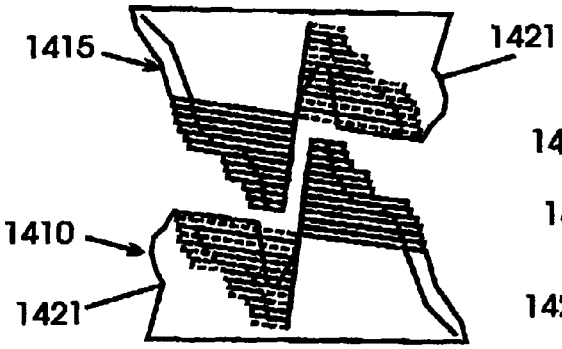
FIG. 66 is a side view of two guitar rest of an alternative embodiment of the present invention, one being flipped over to interlock with the other.
Figure 67:
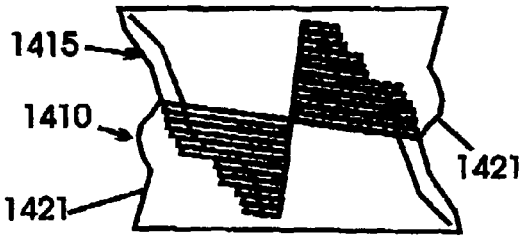
FIG. 67 is a side view of two guitar rest of an alternative embodiment of the present invention, one being flipped over interlocked with the other.
Figure 68:
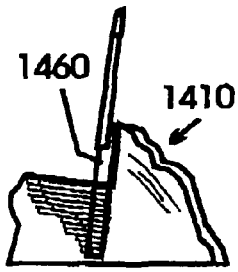
FIGS. 68-75 is a side view of a guitar rest of an alternative embodiment of the present invention, with a stringed instrument inserted therein.
Figure 69:
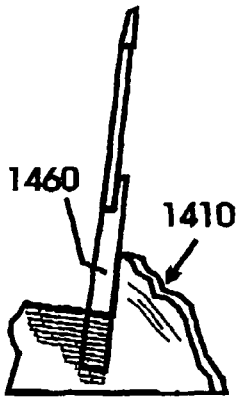
Figure 70:
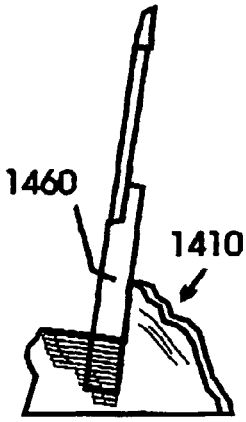
Figure 71:
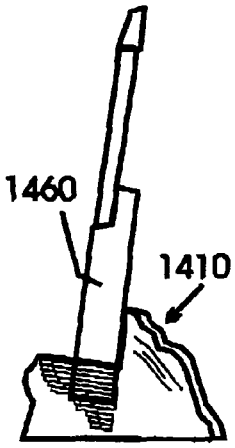
Figure 72:
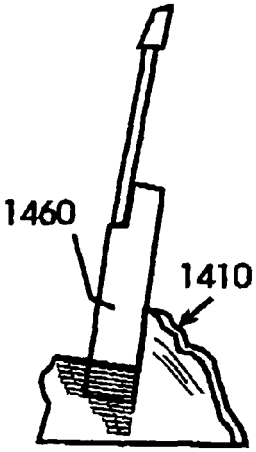
Figure 73:
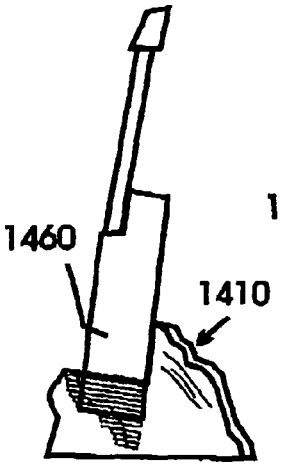
Figure 74:
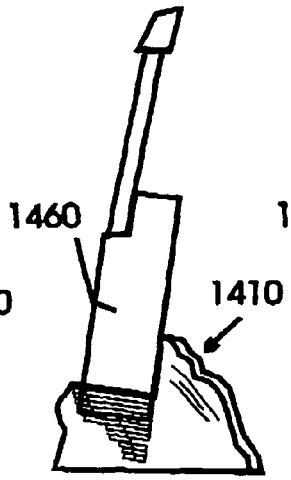
Figure 75:
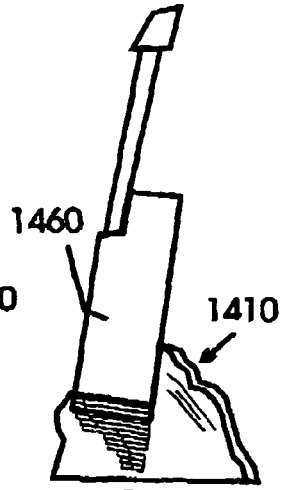
Figure 76:
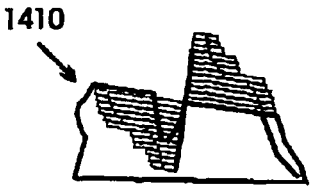
FIG. 76 is a side view of a guitar rest of an alternative embodiment of the present invention.
Figure 79:
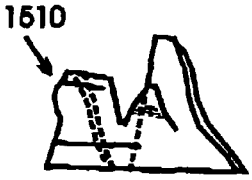
FIG. 79 is a side view of a guitar rest of an alternative embodiment of the present invention.
Figure 82:
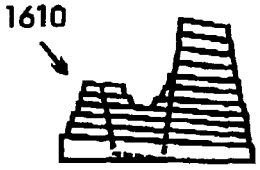
FIG. 82 is a side view of a guitar rest of an alternative embodiment of the present invention.
Figure 77:
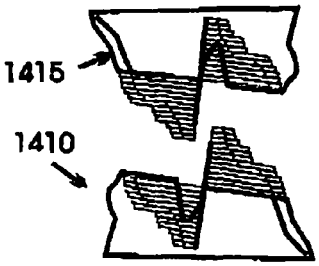
FIG. 77 is a side view of two guitar rest of an alternative embodiment of the present invention, one being flipped over to interlock with the other.
Figure 80:
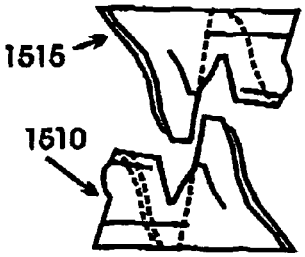
FIG. 80 is a side view of two guitar rest of an alternative embodiment of the present invention, one being flipped over to interlock with the other.
Figure 83:
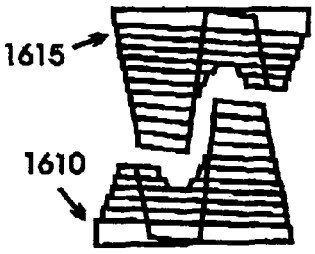
FIG. 83 is a side view of two guitar rest of an alternative embodiment of the present invention, one being flipped over to interlock with the other.
Figure 78:
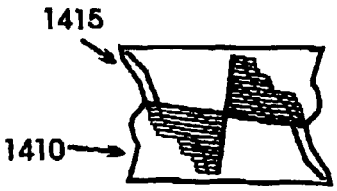
FIG. 78 is a side view of two guitar rest of an alternative embodiment of the present invention, one being flipped over interlocked with the other.
Figure 81:
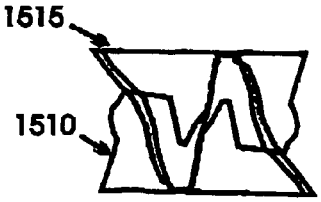
FIG. 81 is a side view of two guitar rest of an alternative embodiment of the present invention, one being flipped over interlocked with the other.
Figure 84:
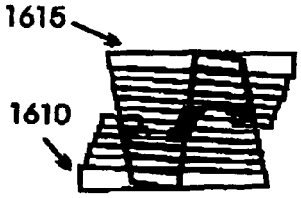
FIG. 84 is a side view of two guitar rest of an alternative embodiment of the present invention, one being flipped over interlocked with the other.
Figure 85:
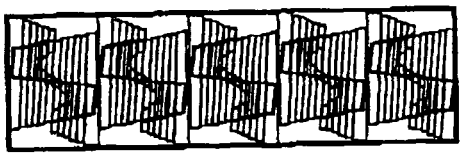
FIG. 85 is a side view of multiple guitar rest of an alternative embodiment of the present invention, stacked for the purposes of shipping or storage.
Figure 86:
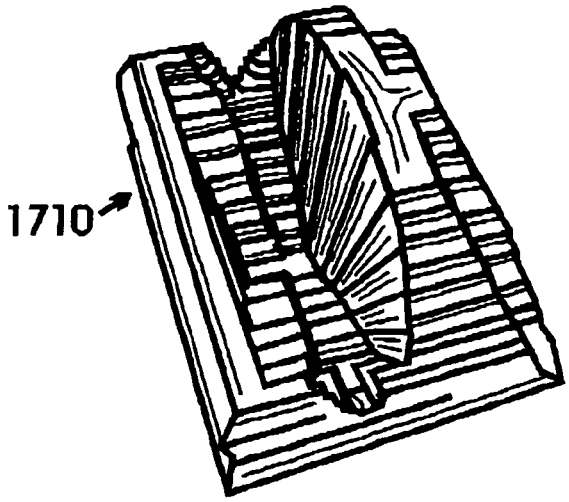
FIG. 86 is a perspective view of a guitar rest of an alternative embodiment of the present invention.
Figure 87:
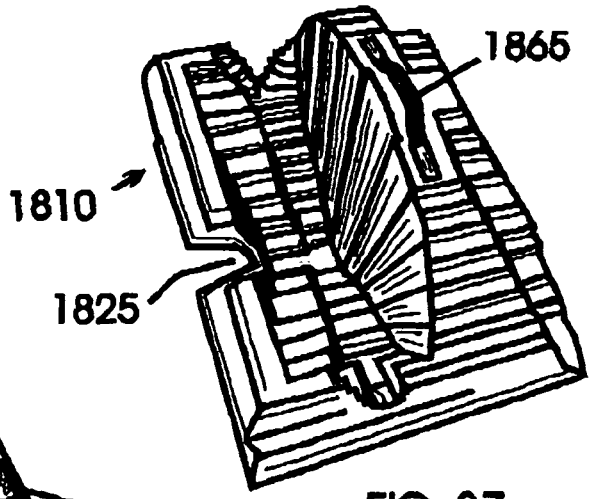
FIG. 87 is a perspective view of a guitar rest of an alternative embodiment of the present invention, with a handle.
Figure 88:
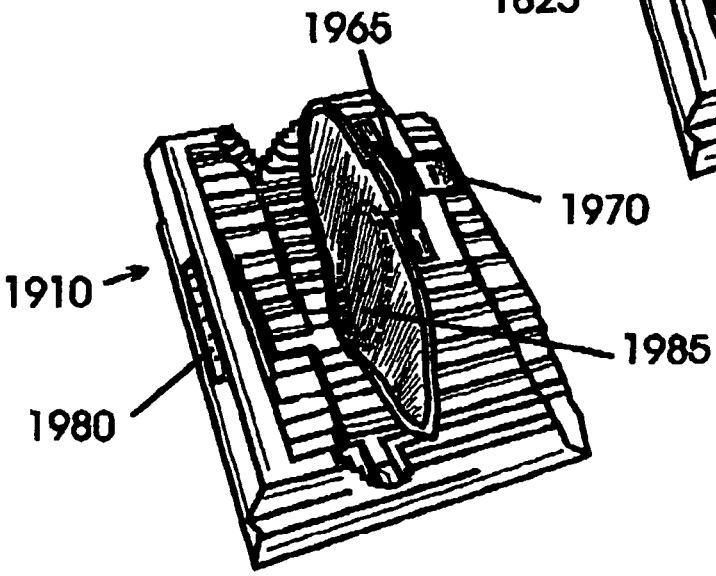
FIG. 88 is a perspective view of a guitar rest of an alternative embodiment of the present invention with electronic accessories (amp board, effects, tuner, etc.) imbedded withing the rest body.
Figure 89:
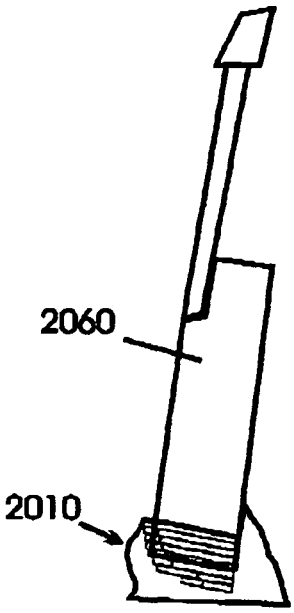
FIG. 89 is a side view of a guitar rest of an alternative embodiment of the present invention, with a stringed instrument inserted therein.
Figure 90:
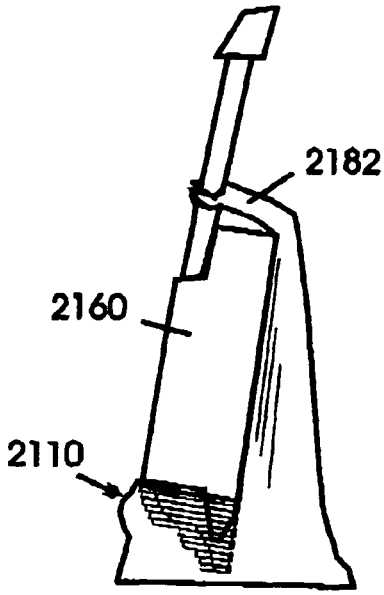
FIG. 90 is a side view of a guitar rest of an alternative embodiment of the present invention, with an internal neck support, with a stringed instrument inserted therein.
Figure 91:
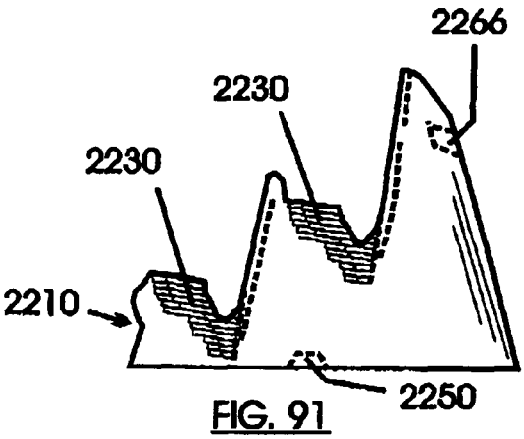
FIG. 91 is a side view, of a guitar rest of an alternative embodiment of the present invention, with multiple cavities.
Figure 92:
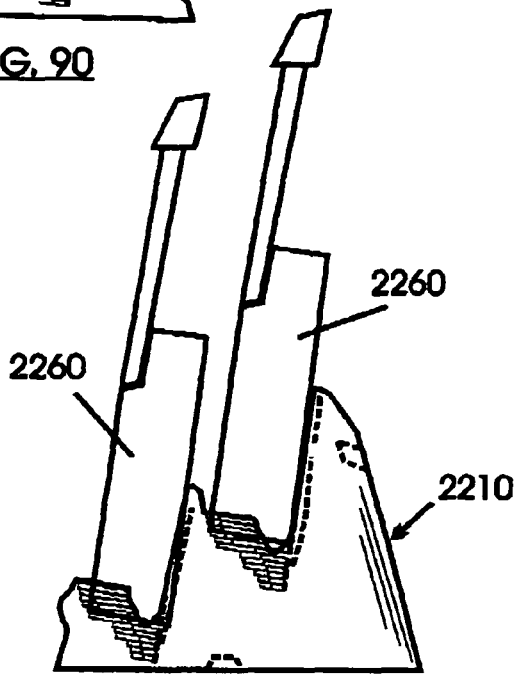
FIG. 92 is a side view of a guitar rest of an alternative embodiment of the present invention, with multiple cavities, with stringed instruments inserted therein.
Figure 93:
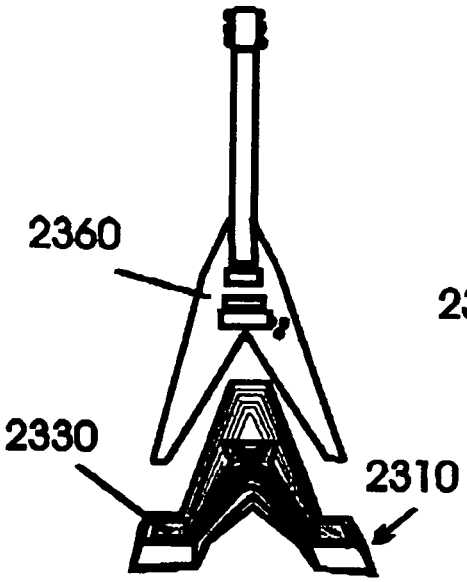
FIG. 93 is a perspective view of guitar rest of an alternative embodiment of the apparatus of the present invention with an electric guitar being inserted therein.
Figure 94:
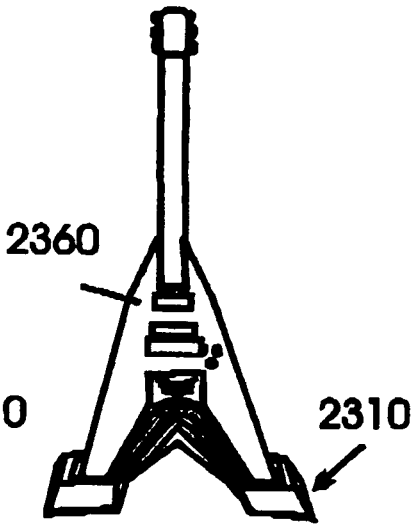
FIG. 94 is a perspective view of guitar rest of an alternative embodiment of the apparatus of the present invention with an electric guitar inserted therein.
Figure 95:
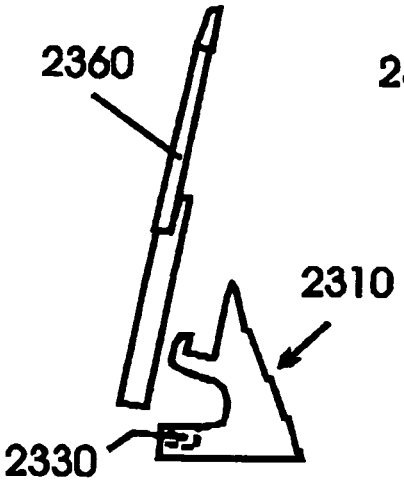
FIGS. 95-96 is a perspective view of guitar rest of an alternative embodiment of the apparatus of the present invention with an electric guitar being inserted therein.
Figure 96:
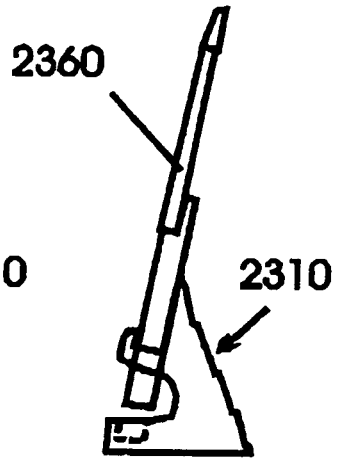
Figure 97:
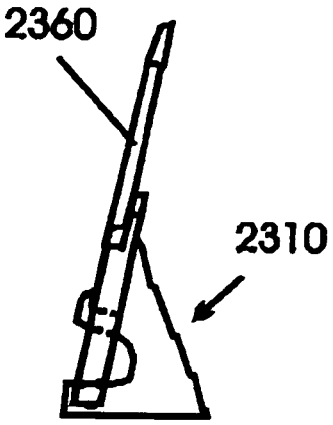
FIG. 97 is a perspective view of guitar rest of an alternative embodiment of the apparatus of the present invention with an electric guitar inserted therein.
Figure 98:
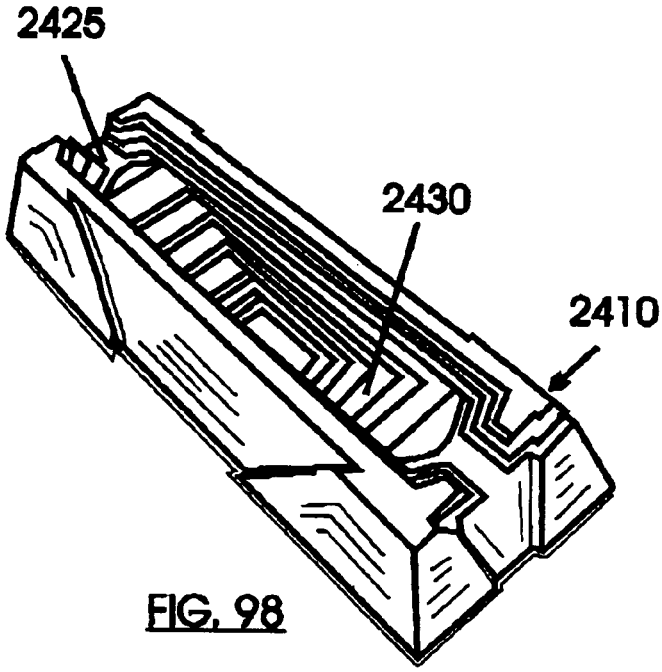
FIG. 98 is a perspective view of a guitar rest of an alternative embodiment of the present invention, with a bi-directional cavity.
Figure 99:
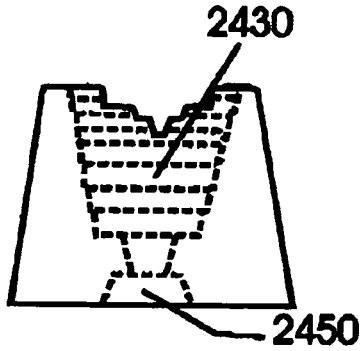
FIG. 99 is a side view of a guitar rest of an alternative embodiment of the present invention, with a bi-directional cavity.
Figure 100:
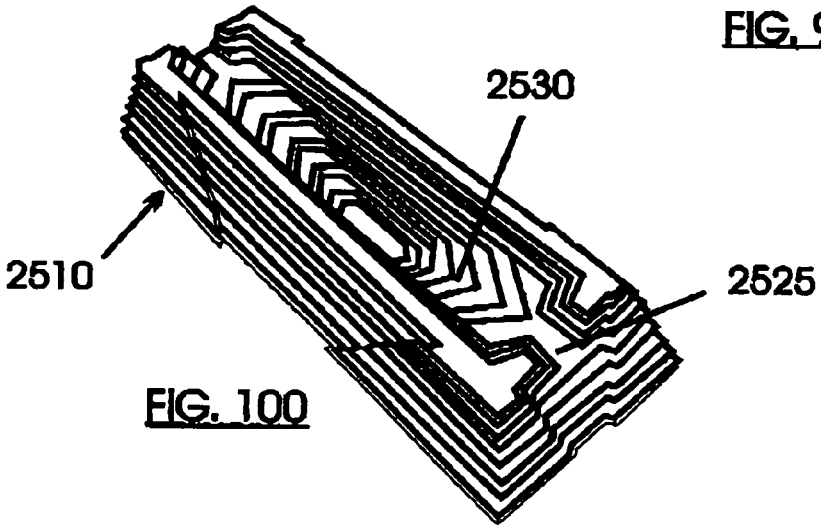
FIG. 100 is a perspective view of a guitar rest of an alternative embodiment of the present invention, with a bi-directional cavity.
Figure 101:
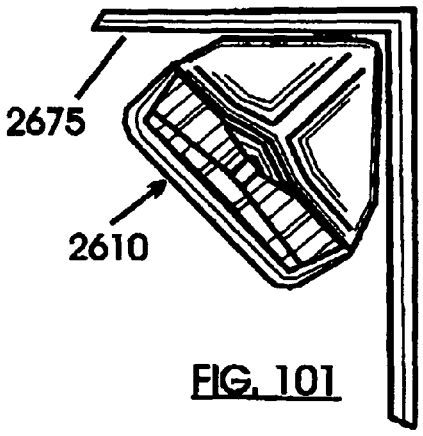
FIG. 101 is a top view of a guitar rest of an alternative embodiment of the present invention, fitting into an inside corner.
Figure 102:
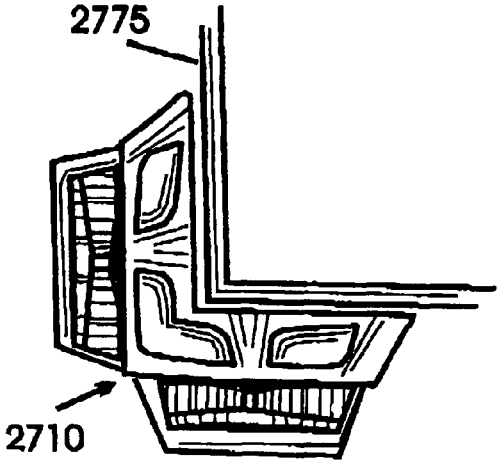
FIG. 102 is a top view of a guitar rest of an alternative embodiment of the present invention, with multiple cavities fitting an outer corner.
Figure 103:
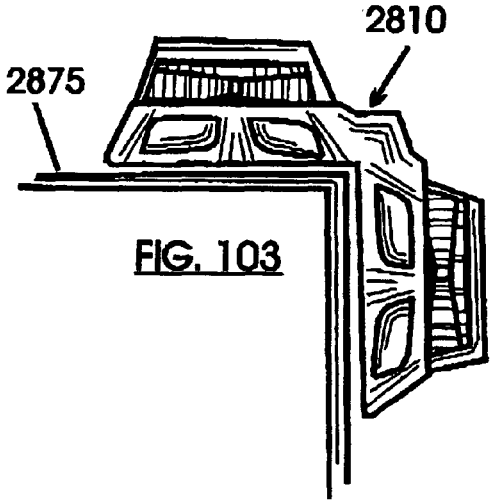
FIG. 103 is a top view of a guitar rest of an alternative embodiment of the present invention, with multiple cavities fitting an outer corner.
Figure 104:
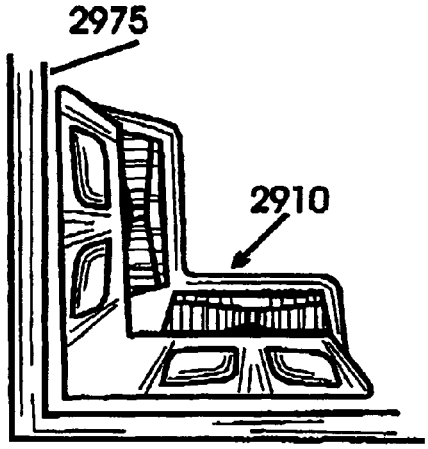
FIG. 104 is a top view of a guitar rest of an alternative embodiment of the present invention, with multiple cavities fitting into an inside corner.
Figure 105:
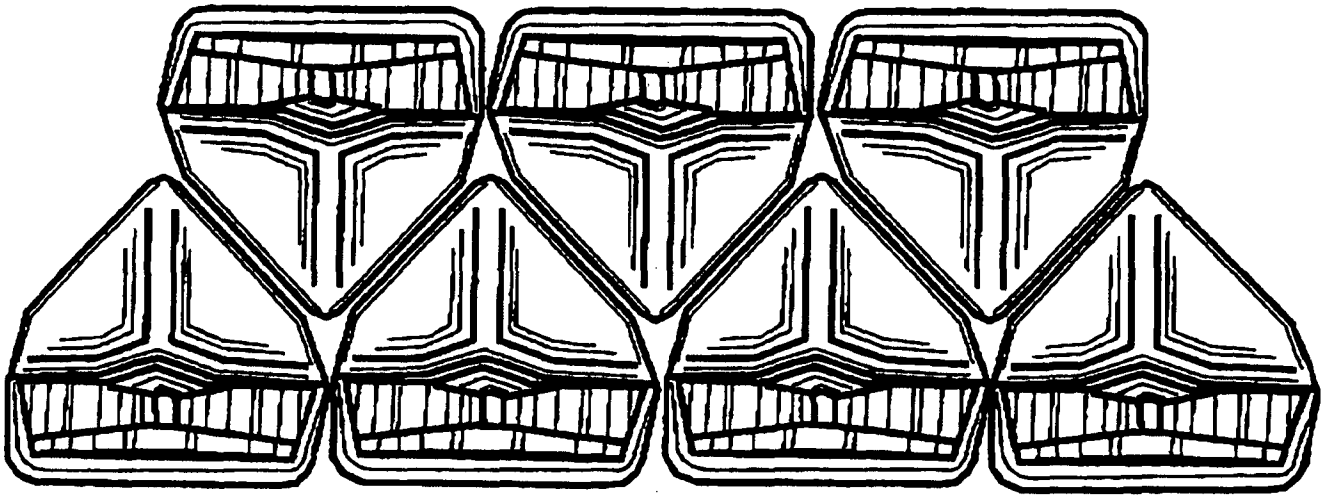
FIG. 105 is a top view of multiple guitar rest of an alternative embodiment of the present invention, illustrating a display arrangement.
Figure 106:
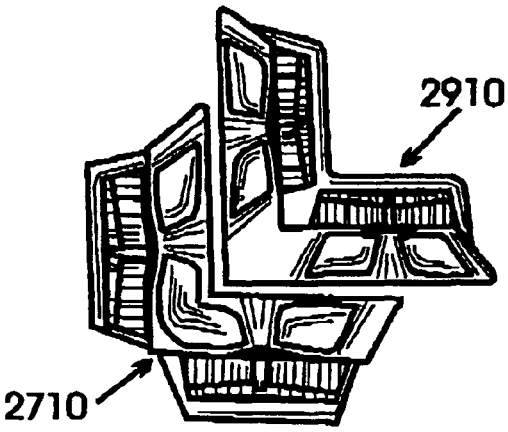
FIG. 106 is a top view of multiple guitar rest of an alternative embodiment of the present invention, illustrating a display arrangement.
Figure 107:
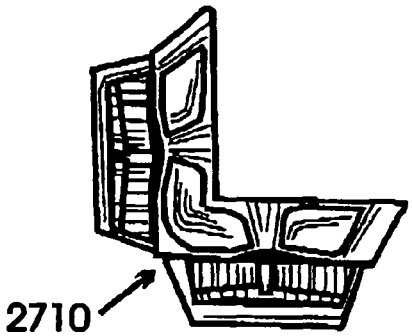
FIG. 107 is a top view of a guitar rest of an alternative embodiment of the present invention, with multiple cavities.
Figure 108:
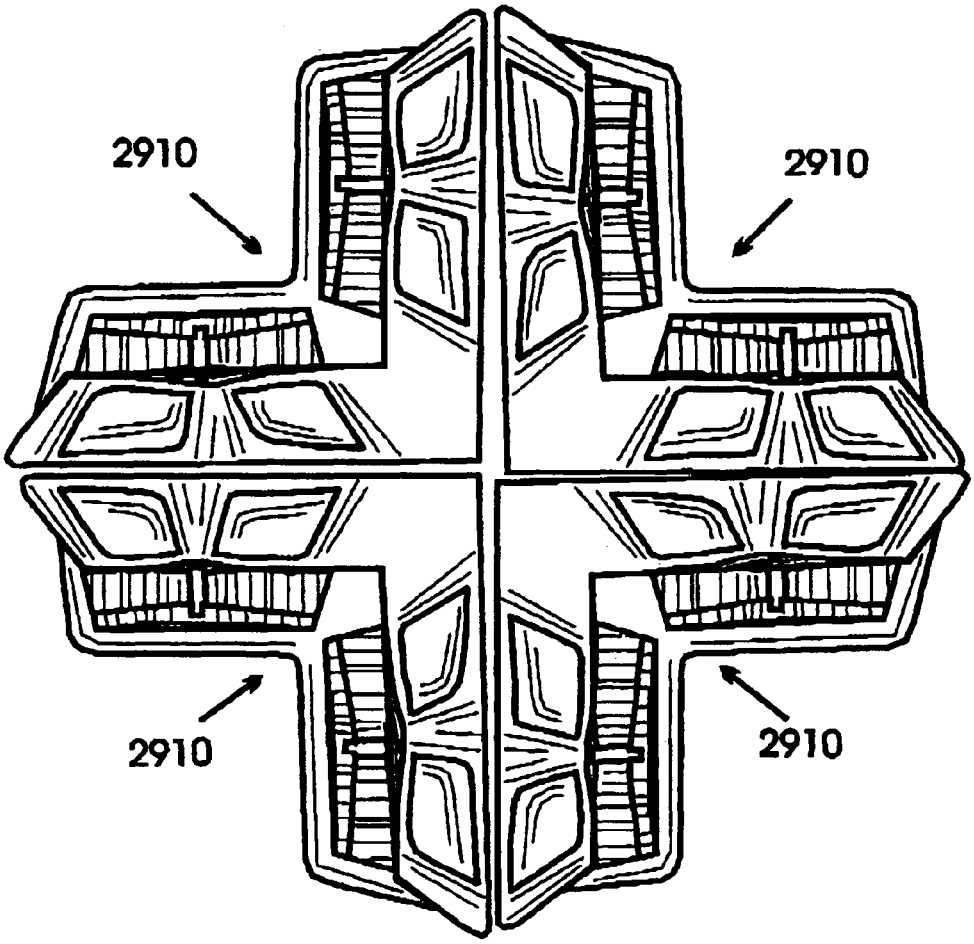
FIG. 108 is a top view of multiple guitar rest of an alternative embodiment of the present invention, illustrating a display arrangement.
Figure 109:
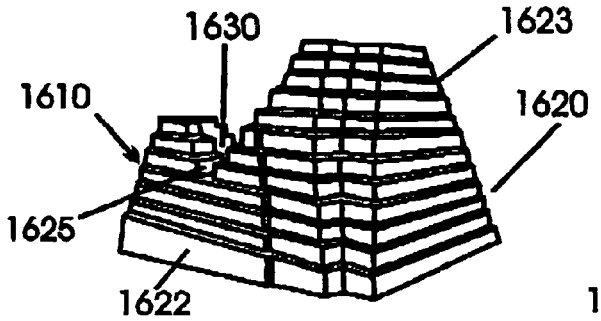
FIG. 109 is a perspective rear view of a guitar rest of an alternative embodiment of the present invention.
Figure 110:
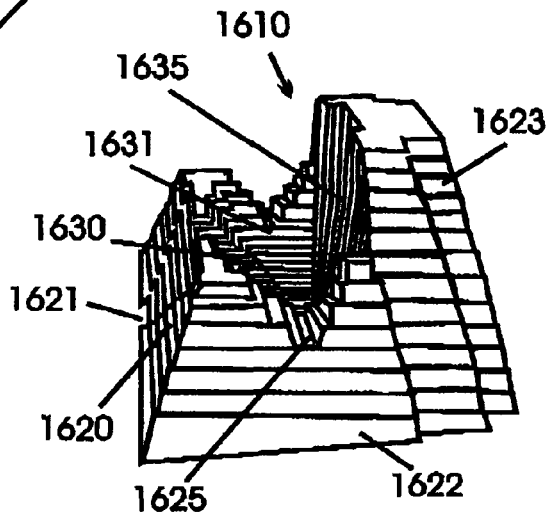
FIG. 110 is a perspective view of a guitar rest of an alternative embodiment of the present invention.
Figure 111:
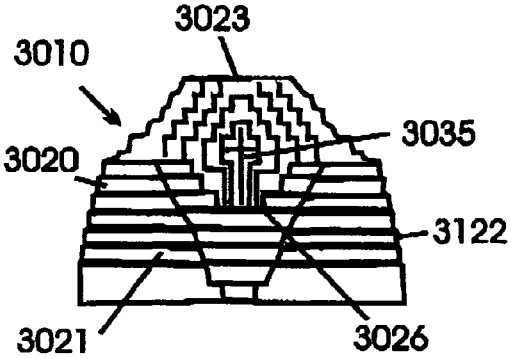
FIG. 111 is a front view of a guitar rest of an alternative embodiment of the present invention.
Figure 112:
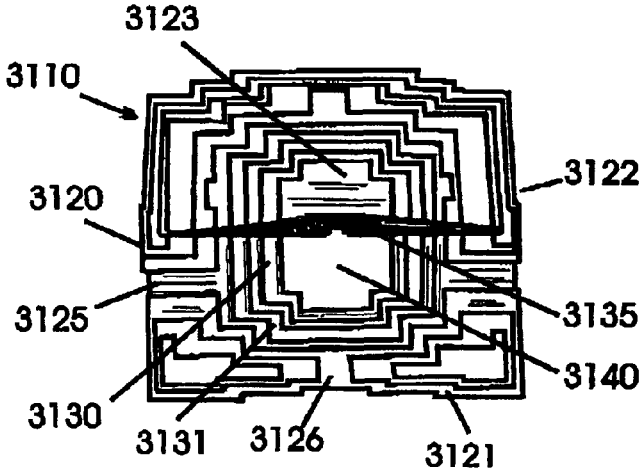
FIG. 112 is a top view of a guitar rest of an alternative embodiment of the present invention.

The instrument rest of the present invention is a unique style of stand for guitars or other instruments that uses a different concept from all other stands of today. The instrument rest of the present invention is a holder or rest for guitars and other instruments.

Functionality

The instrument rest of the present invention is designed so that a musician can rest the bottom of an instrument on/in the rest, while resting the neck and/or headstock backwards against another object (such as an amplifier, speaker, chairs or even just a bare wall).

Material Composition

The instrument rest of the present invention is preferably made of either a molded polyurethane foam, ester#3, urethane foam, #1570bl, or some similar but not always chemically the same as, yet providing a similar working effect of, a foam type material, and may consist of several different compounds all together.

Specifications

The instrument rest of the present invention is designed to hold a wide range of instruments no matter the shape, size or weight (electric guitars, box guitars, bass guitars, violins, horns, etc.). Factors such as color, density, texture and actual dimensions will be determined upon manufacture and will be influenced by the type of instrument for which the rest is designed.

Features and Benefits

The instrument rest of the present invention will eliminate the sense of insecurity and inconvenience of contemporary stands, by allowing the musician to rest his or her instrument in places not allowed by contemporary stands (on top of amps, behind or beside amps, behind doors, on shelves—just about anywhere where conventional stands will not fit, the instrument rest of the present invention will).

The instrument rest of the present invention will accommodate instruments that do not fit properly in contemporary stands.

The instrument rest of the present invention is preferably of one-piece construction, and is preferably compact and lightweight.

The uniqueness of the design of the instrument rest of the present invention allows for better weight support, superb balancing, and convenience of placement for an instrument.

The instrument rest of the present invention can be carried in most standard guitar cases, without damaging the instrument.

The instrument rest of the present invention will protect the finish of the instrument, by virtue of its design.

The instrument rest of the present invention can be made in extreme color variations, and in unique designs.

When using the instrument rest of the present invention, usually the instrument must be leaned against another object—the instrument rest of the present invention is usually not designed to solely support the instrument (it usually does not make the instrument free-standing—though some light guitar-like instruments will stand up in the instrument rest of the present invention with no other support).

The instrument rest of the present invention provides a lean-anywhere resting place.

The instrument rest of the present invention frees up valuable floor space.

The instrument rest of the present invention is compact, lightweight and durable.

The instrument rest of the present invention is preferably colorful and stylish, with a leather-like feel (when made with molded urethane foam, for example).

Cords will never tangle on the instrument rest of the present invention.

No assembly is required for standard models of the instrument rest of the present invention.

The strap pin locations will vary in location, size, and number.

As used herein, "guitar-like instrument" refers to stringed musical instruments such as electric guitars, box guitars, bass guitars, banjoes, mandolins, fiddles, violins, but excluding free-standing instruments such as harps.

PARTS LIST

The following is a list of parts and materials suitable for use in the present invention:

10 instrument rest of the preferred embodiment of the present invention

10A-10N and 10P-10V are instrument rests of alternative embodiments of the present invention

20 rest body

21 front of rest body

22 side of rest body

23 rear of rest body

30 cavity for receiving guitar-like instrument

34 cavity for receiving guitar-like instrument

35 instrument rest of an alternative embodiment of the present invention

36 guitar

37 rest body

38 front of rest body 37

39 side of rest body 37

40 groove for strap pin

44 cavity for receiving guitar-like instrument

45 instrument rest of an alternative embodiment of the present invention

46 guitar
47 rest body
48 front of rest body 37
49 side of rest body 37
50 groove for amp handle
54 cavity for receiving musical instrument
55 instrument rest of an alternative embodiment of the present invention
56 musical instrument
57 rest body
58 front of rest body 37
59 side of rest body 37
60 electric guitar
61 amp
62 speaker
63 neck of electric guitar 60
64 cords of guitar 60
65 box guitar
66 tripod stand
67 forks of tripod stand 66
70 neck rest pad of the preferred embodiment of the present invention (can be compressed between amp 61 and speaker 62)
71 compression holes in neck rest pad 70 (will vary in size and quantity)
72 neck support area of neck rest pad 70
75 wall
80 pegboard neck rest pad
81 metal pegboard hooks of pad 80
82 neck support area of neck rest pad 80
83 pegboard
85 neck rest pad
86 neck support area of neck rest pad 85
87 strap of neck rest pad 85 (preferably nylon or Velcro brand hook-and-loop fastener material)
90 headstock rest pad of the preferred embodiment of the present invention
91 headstock support area of headstock rest pad 90
92 strap of headstock rest pad 90 (preferably nylon)
95 headstock rest pad of an alternative embodiment of the present invention
96 headstock support area of headstock rest pad 95
110 freestanding guitar rest of an alternative embodiment of the present invention (it cradles more of the guitar than a standard rest 10)
120 rest body
121 front of rest body
122 side of rest body
123 rear of rest body
124 V-notch to allow for cords 64
130 cavity for receiving guitar-like instrument
134 cavity for receiving guitar-like instrument
135 instrument rest of an alternative embodiment of the present invention
136 guitar
137 rest body
138 front of rest body 137
139 side of rest body 137
144 cavity for receiving guitar-like instrument
145 instrument rest of an alternative embodiment of the present invention
147 rest body
148 front of rest body 147
149 side of rest body 147
210 instrument rest of an alternative embodiment of the present invention
220 rest body
221 front of rest body
222 side of rest body
223 raised rear of rest body to provide upright support
230 cavity for receiving guitar-like instrument
250 groove for amp handle
310 instrument rest of an alternative embodiment of the present invention
320 rest body
321 front of rest body
322 side of rest body
323 raised rear of rest body to provide upright support
330 cavity for receiving guitar-like instrument
331 cord recess to allow for cord for side-jacked instruments
350 groove for amp handle
410 instrument rest of an alternative embodiment of the present invention
420 rest body
421 front of rest body
422 side of rest body
431 tripod holes preferably completely through the body 420 to allow rest 410 to be slipped onto a conventional forked tripod stand 66
510 instrument rest of an alternative embodiment of the present invention
520 rest body
521 front of rest body
522 side of rest body
530 cavity for receiving guitar-like instrument
531 strap (nylon, e.g.) for connecting the left and right pieces of body 520
610 instrument rest of an alternative embodiment of the present invention
620 rest body
621 front of rest body
622 side of rest body
630 cavity for receiving guitar-like instrument
631 strap (nylon, e.g.) for connecting the left and right pieces of body 520
660 guitar
710 instrument rest of an alternative embodiment of the present invention
720 rest body
721 front of rest body
722 side of rest body
730 cavity for receiving guitar-like instrument
810 instrument rest of an alternative embodiment of the present invention
820 rest body
821 front of rest body
822 side of rest body
830 cavity for receiving guitar-like instrument
910 instrument rest of an alternative embodiment of the present invention
920 rest body
921 front of rest body
922 side of rest body
930 cavity for receiving guitar-like instrument
1010 freestanding guitar rest of an alternative embodiment of the present invention (it cradles more of the guitar than a standard rest 10)
1020 rest body
1021 front of rest body
1022 side of rest body
1023 raised rear of rest body to provide upright support
1025 V-notch to allow for cords
1030 cavity for receiving guitar like instrument

1035 cavity for receiving guitar like instruments with slope backs
1040 cavity to receive strap pin
1210 freestanding guitar rest of an alternative embodiment of the present invention
1220 rest body
1221 front of rest body
1222 side of rest body
1223 raised rear of rest body to provide upright support
1225 V-notch to allow for cords
1230 cavity for receiving guitar like instrument
1310 freestanding guitar rest of an alternative embodiment of the present invention
1320 rest body
1321 front of rest body
1322 side of rest body
1323 raised rear of rest body to provide upright support
1325 V-notch to allow for cords
1330 cavity for receiving guitar like instrument
1410 freestanding guitar rest of an alternative embodiment of the present invention
1415 guitar rest inverted upside down
1420 rest body
1421 front of rest body
1422 side of rest body
1423 raised rear of rest body to provide upright support
1425 v-notch to allow for cords
1430 primary cavity for receiving guitar like instrument
1431 secondary cavity for receiving guitar like instrument, multi stage cavities allow different size guitar like instruments
1435 cavity for receiving guitar like instruments with slope backs
1440 cavity to receive strap pin
1450 amp handle groove
1460 guitar
1510 freestanding guitar rest of an alternative embodiment of the present invention
1515 upside Down freestanding guitar rest of an alternative embodiment of the present invention
1610 freestanding guitar rest of an alternative embodiment of the present invention
1615 upside Down freestanding guitar rest of an alternative embodiment of the present invention
1710 freestanding guitar rest of an alternative embodiment of the present invention
1810 freestanding guitar rest of an alternative embodiment of the present invention
1825 v-notch to allow for cords
1865 carry handle
1910 freestanding guitar rest of an alternative embodiment of the present invention
1965 carry handle
1970 accessary,
1980 accessary,
1985 speaker
2010 freestanding guitar rest of an alternative embodiment of the present invention
2060 guitar
2110 freestanding guitar rest of an alternative embodiment of the present invention
2160 guitar
2182 integral neck support
2210 freestanding guitar rest of an alternative embodiment of the present invention
2230 cavity for receiving guitar like instrument
2250 amp handle groove
2260 guitar
2266 carry handle notch
2310 freestanding guitar rest of an alternative embodiment of the present invention
2330 cavity for receiving guitar like instrument
2360 guitar
2410 freestanding guitar rest of an alternative embodiment of the present invention
2425 v-notch to allow for cords
2430 primary cavity for receiving guitar like instrument
2450 amp handle groove
2510 freestanding guitar rest of an alternative embodiment of the present invention
2525 v-notch to allow for cords
2530 primary cavity for receiving guitar like instrument
2610 freestanding guitar rest of an alternative embodiment of the present invention
2675 wall
2710 freestanding guitar rest of an alternative embodiment of the present invention
2775 wall
2810 freestanding guitar rest of an alternative embodiment of the present invention
2875 wall
2910 freestanding guitar rest of an alternative embodiment of the present invention
2975 wall
3010 freestanding guitar rest of an alternative embodiment of the present invention
3020 rest body
3021 front of rest body
3022 side of rest body
3023 raised rear of rest body to provide upright support
3025 v-notch to allow for cords
3026 v-notch to allow for bridges and cords
3035 cavity for receiving guitar like instruments with slope backs
3110 freestanding guitar rest of an alternative embodiment of the present invention
3120 rest body
3121 front of rest body
3122 side of rest body
3123 raised rear of rest body to provide upright support
3125 v-notch to allow for cords
3126 v-notch to allow for bridges and cords
3130 primary cavity for receiving guitar like instrument
3131 secondary cavity for receiving guitar like instrument, multi stage cavities allow different size guitar like instruments
3135 cavity for receiving guitar like instruments with slope backs
3140 cavity to receive strap pin Dimensions (Potential approximate preferred ranges)
A 0.5" to 22.0"
B 0.125" to 18.0"
C 0.125" to 16.0"
D 0.5" to 22.0"
E 0.0" to 8.0"
F 0 to 60 Degrees
G 0.0" to 2.5"
H 0.0" to 2.0"
A1 1.0" to 26.0"
B1 3.0" to 38.0"
C1 1.25" to 24.0"
A2 2.0" to 38.0"
B2 2.0" to 38.0"
C2 0.5" to 22.0"

A3 2.0" to 38.0"
B3 0.0" to 38.0"
C3 0.125" to 16.0"
A4 0.0" to 15.0"
B4 0.0" to 2.5"

This product may optionally have an exterior coating applied depending upon the type of foam used by the manufacturer. The coatings may vary from a urethane to a synthetic cloth type material depending on coatings market technology.

The following are exemplary values for the following dimensions of the rest when used with a standard electric guitar:

A—2.065"
B—1.750"
C—1.500"
D—1.935"
E—0.625" (strap pin groove depth)
F—15-20 degrees (chosen to allow the instrument to rest in a backwards position, against another object)
G—1.250" (width of groove to fit over amplifier handle)
H—0.750" (depth of groove to fit over amplifier handle)
A1—4.500"
B1—12.500"
C1—3.500"
A2—10.125"
B2—9.875"
C2—2.062"
A3—10.125" (rear)
—9.875" (front)
B3—2"
C3—2.375"
A4—11.0"
B4—1.937"

The following are exemplary values for the following dimensions of the rest when used with a standard large box guitar:

A—5.250"
B—2.125"
C—1.500"
D—5.000"
E—0.625"
F—15-20 degrees
G—1.250"
H—0.750"
A1—7.000"
B1—16.000"
C1—3.250"
A2—13.375"
B2—11.875"
C2—5.250"
A3—13.375" (rear)
—11.875" (front)
B3—2.000"
C3—2.375"
A4—11.0"
B4—1.937"

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. Apparatus comprising:
a guitar-like instrument having a bottom in combination with a soft bottom rest having an angled cavity which is internally configured to receive the guitar-like instrument, the cavity shaped to surround the bottom of the guitar-like instrument.

2. The apparatus of claim 1, wherein:
the guitar-like instrument is an electric guitar.

3. The apparatus of claim 1, further comprising:
a cavity for receiving an amp handle.

4. The apparatus of claim 1, further comprising:
a cushion for supporting the neck of a guitar.

5. The apparatus of claim 1, further comprising:
a cushion for supporting the headstock of a guitar.

6. Apparatus including:
a protective device for musical instruments comprising:
a soft bottom rest which is internally configured to receive a guitar-like instrument having a bottom, the rest having an angled cavity for receiving and surrounding the bottom of the guitar-like instrument and allowing the guitar-like instrument to rest against a wall or other substantially vertical structure.

7. The apparatus of claim 6, further comprising:
the guitar-like instrument.

8. The apparatus of claim 6, further comprising:
a case for the guitar-like instrument.

9. The apparatus of claim 6, wherein:
the angled cavity is shaped to closely receive the bottom of the guitar-like instrument.

10. Apparatus comprising:
a guitar having a bottom in combination with a soft bottom rest having an angled cavity which is internally configured to receive said guitar, the cavity shaped to surround the bottom of the guitar.

11. The apparatus of claim 10, wherein:
the guitar is an acoustic guitar.

12. The apparatus of claim 10, further comprising:
a cavity for receiving an amp handle.

13. The apparatus of claim 10, further comprising:
a cushion for supporting the neck of a guitar.

14. The apparatus of claim 10, further comprising:
a cushion for supporting the headstock of a guitar.

* * * * *